US007422244B1

(12) United States Patent
Redmond et al.

(10) Patent No.: US 7,422,244 B1
(45) Date of Patent: Sep. 9, 2008

(54) IDENTIFICATION DOCUMENT WITH DOCUMENT SPECIFIC REDUCED SCALE PRINTING

(75) Inventors: James D. Redmond, Fort Wayne, IN (US); Dawn E. DePrey, Fort Wayne, IN (US)

(73) Assignee: Digimarc Corporation, Beaverton, OR (US)

( * ) Notice: Subject to any disclaimer, the term of this patent is extended or adjusted under 35 U.S.C. 154(b) by 1176 days.

(21) Appl. No.: 09/090,067

(22) Filed: Jun. 3, 1998

(51) Int. Cl.
*B42D 15/00* (2006.01)

(52) U.S. Cl. ..... 283/93; 283/67; 283/74

(58) Field of Classification Search ..... 283/67, 283/74, 76, 91, 113, 114
See application file for complete search history.

(56) References Cited

U.S. PATENT DOCUMENTS

| | | | | | |
|---|---|---|---|---|---|
| 1,428,278 | A | * | 9/1922 | Dow | 283/114 |
| 3,704,068 | A | * | 11/1972 | Waly | 355/46 |
| 4,234,214 | A | | 11/1980 | Lee | 283/57 |
| 4,239,261 | A | * | 12/1980 | Richardson | 283/74 |
| 4,597,592 | A | | 7/1986 | Maurer | 283/75 |
| 4,663,518 | A | * | 5/1987 | Borror et al. | 235/487 |
| 4,675,746 | A | | 6/1987 | Tetrick et al. | 358/296 |
| 4,689,477 | A | * | 8/1987 | Goldman | 235/380 |
| 4,790,566 | A | | 12/1988 | Boissier et al. | 283/91 |
| 4,884,828 | A | | 12/1989 | Burnham et al. | 283/89 |
| 4,891,666 | A | | 1/1990 | Gordon | 355/133 |
| 5,062,666 | A | | 11/1991 | Mowry et al. | 283/67 |
| 5,157,424 | A | | 10/1992 | Craven et al. | 346/160 |
| 5,178,418 | A | * | 1/1993 | Merry et al. | 283/73 |
| 5,284,364 | A | | 2/1994 | Jain | 283/87 |
| 5,380,044 | A | * | 1/1995 | Aitkens et al. | 283/67 |
| 5,420,924 | A | | 5/1995 | Berson et al. | 380/23 |

FOREIGN PATENT DOCUMENTS

| | | | |
|---|---|---|---|
| EP | 439 909 | A2 | 8/1991 |
| EP | 439 909 | A3 | 8/1991 |
| FR | 440 078 | A | 7/1912 |
| GB | 139 157 | A | 8/1921 |
| GB | 2159461 | A * | 12/1985 |

OTHER PUBLICATIONS

PCT International Search Report, PCT/US 99/12282, Dec. 10, 1999.

* cited by examiner

*Primary Examiner*—Monica S. Carter

(57) ABSTRACT

An identification document which includes card specific information printed on the card in a first location at a relatively large scale which permits the information to be read without magnification and duplicates the card specific information at a second location on the card at a significantly smaller scale which requires magnification to clearly read the small scale information. The micro-printing of small scale card specific information, such as a person's date of birth on a driver's license, at a second location on the identification card allows the micro-printed text to be compared to the large scale text to determine if the large scale text has been altered.

16 Claims, 3 Drawing Sheets

IDENTIFICATION DOCUMENT WITH DOCUMENT SPECIFIC REDUCED SCALE PRINTING

BACKGROUND OF THE INVENTION

1. Field of the Invention

The present invention relates to identification cards and, more specifically, to the use of micro-printing on such cards to inhibit the alteration or forgery of such cards.

2. Description of the Related Art

There are a large number of documents which are commonly used to identify individual people or objects, or which represent or convey financial value. Driver's licenses and employee badges are two examples of highly prevalent identification documents. Identification documents may also be employed with objects. Such documents may be used to establish that a particular object has been inspected, passed through customs or possesses some other attribute which affects its value. For example, an identification document may be used to establish the provenance of an artwork or the pedigree of an animal. Documents may also be employed as financial instruments such as money orders and stock certificates.

The value of these identification documents provides an incentive for the unlawful alteration or counterfeiting of such documents. A large variety of means, both simple and sophisticated have been developed to hinder the alteration and counterfeiting of such documents.

A relatively simple and cost efficient type of identification card for an individual typically contains textual matter pertaining to the specific individual identified in the card, such as the person's name, address, date of birth and some type of identifying number such as a driver's license, social security or other unique serial number. The card may also contain information on the person's physical characteristics such as hair color, eye color, height and weight and display the person's signature and photograph.

Such cards are not fool-proof, however, and it is not uncommon for individuals to attempt to alter such documents by changing some of the printed text found on the card or by substituting a different photograph. For example, alterations to the date of birth on such cards may be made by minors who wish to illegally purchase alcohol or such individual may attempt to substitute their own photograph in a card which identifies an older individual.

To prevent such tampering and the production of counterfeit cards, identification cards may employ various well-known deterrent methods. For example, the card may contain elements which are difficult to replicate such as holograms. The cards may also be constructed of materials which are destroyed upon an attempt to tamper with the card. The cards may also employ means to record data which cannot be directly read by a human viewer such as magnetically recorded or bar coded data. This recorded data may also be encrypted to provide further security. Micro-printing, which cannot be easily read without magnification and which is often found on paper currency, may also be used. The difficulty of faithfully reproducing the micro-printed text inhibits the production of counterfeit documents. A brief review of several of these methods can be found in U.S. Pat. No. 5,284,364.

These measures provide different levels of deterrence. Generally, the more sophisticated measures provide a greater measure of security but at a higher level of cost.

SUMMARY OF THE INVENTION

The present invention provides a cost efficient mechanism for enhancing the tamper resistance of an identification document.

The invention comprises, in one form thereof, an identification document which includes printed matter conveying information specific to an individual at a large scale which enables a viewer to easily read the information and printing that same individual specific information on the identification document at a second location at a significantly smaller scale. The printing of the information at the second location may either graphically reproduce the first printed matter at a smaller scale or it may represent that same information in a graphically different manner.

An advantage of the present invention is that alterations to the large scale printed matter on the document which has been duplicated elsewhere on the document in micro-printed text can be detected by comparing the large scale text to the small scale micro-printed text. This provides a cost efficient mechanism for deterring the alteration of the large scale text on such documents.

Another advantage of the invention is that by micro-printing individual specific information on the identification document, the production of counterfeit identification cards is inhibited. For example, if identical micro-printed text were placed on all of the documents, a counterfeiter who was able to reproduce the micro-printed text could produce a large number of counterfeit documents with that micro-printed text. If, however, the micro-printed text varied from document to document, the counterfeiter will have to reproduce a number of different micro-printed text strings to produce a large number of counterfeit documents with sufficient variety to escape detection.

Yet another advantage of the invention is that the small scale printed matter may be placed at more than one location on the document. The public can be widely notified of the use of one of the locations while maintaining at least one location confidential. In this manner the publicized location will work as a deterrent to those considering alteration or counterfeiting of the document while the confidential location may be overlooked by those actually engaging in such activities. A balance between the advantages of publicity, which can deter illicit activity, and confidentiality, which can facilitate the detection of such activity, may thereby be achieved. Alternatively, the use of such micro-printed text may be kept completely confidential or publicized in its entirety in an attempt to maximize one of these two benefits.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
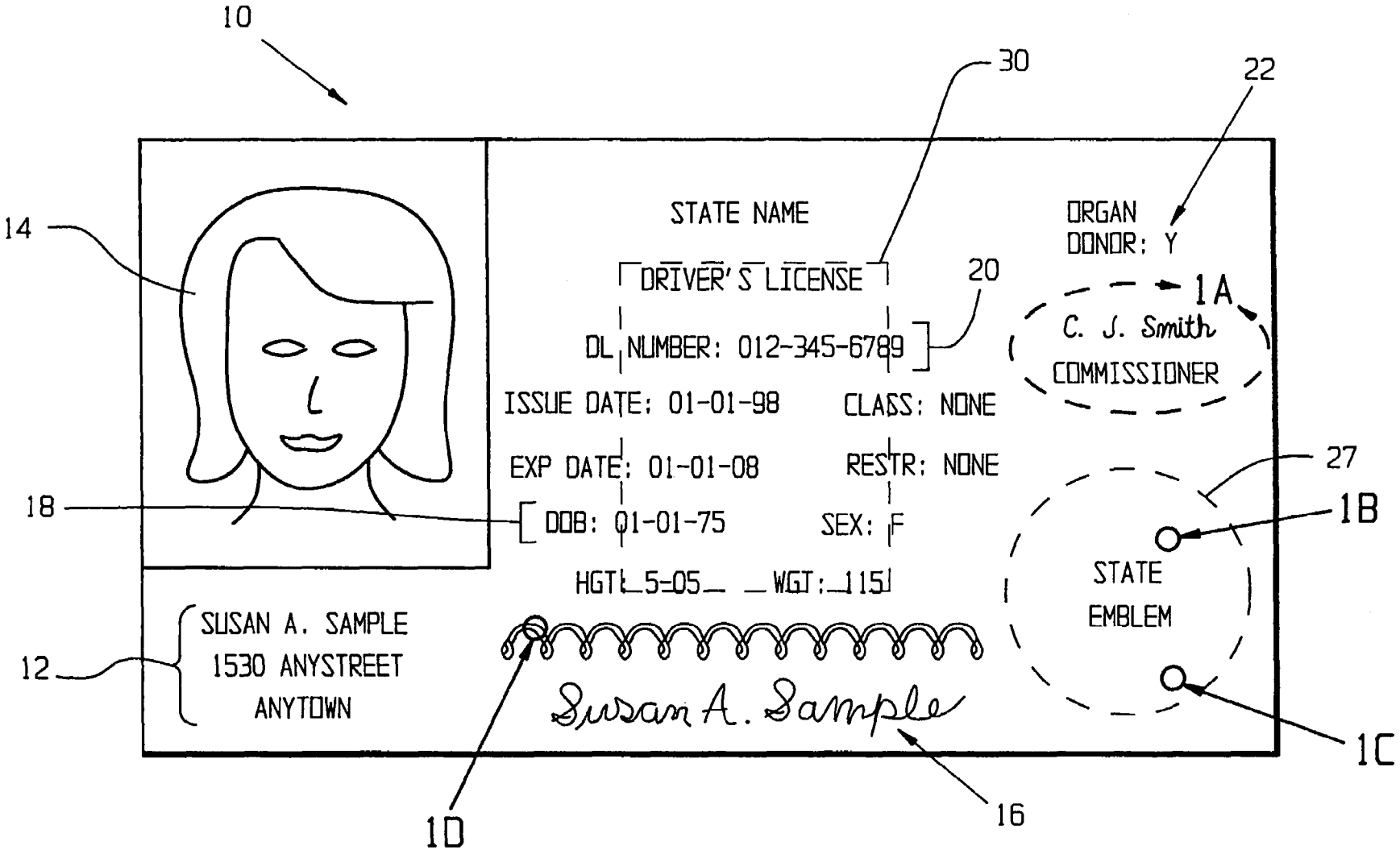
FIG. 1 is a view of an identification card embodying the present invention.
Figure 1A:
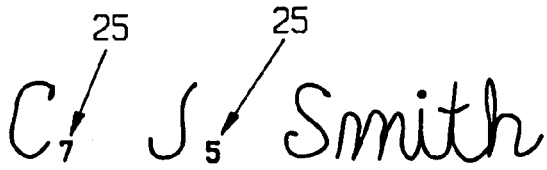
FIG. 1A is a magnified view of area 1A of the identification card in FIG. 1 embodying the present invention.
Figure 1B:
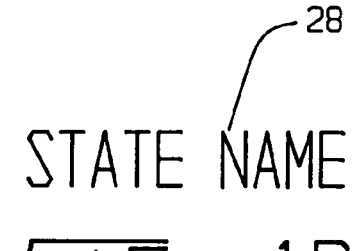
FIG. 1B is a magnified view of area 1B of the identification card in FIG. 1 embodying the present invention.
Figure 1C:
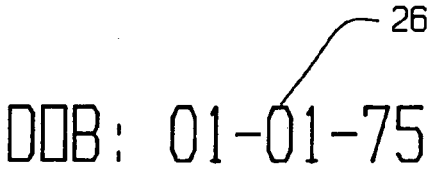
FIG. 1C is a magnified view of area 1C of the identification card in FIG. 1 embodying the present invention.
Figure 1D:
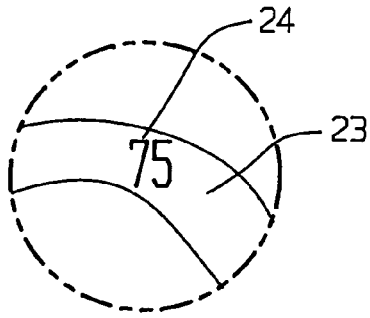
FIG. 1D is a magnified view of area ID of the identification card in FIG. 1 embodying the present invention.

Corresponding reference characters indicate corresponding parts throughout the several views. Although the drawings represent an embodiment of the present invention, the drawings are not necessarily to scale and certain features may be exaggerated or simplified in order to clearly illustrate and explain the present invention. The exemplification set out herein provides an illustrative embodiment of the invention and is not intended to be an exhaustive illustration of the invention or to be construed as limiting the scope of the invention.

DESCRIPTION OF THE PRESENT INVENTION

Referring now to the drawings and particularly to FIG. 1, there is shown an identification card 10. In the illustrated embodiment card 10 is a driver's license which includes a variety of information including the name and address 12, photograph 14, signature 16, date of birth 18, driver's license number 20 and organ donor status 22 of the particular person identified by the card.

The information printed on the card may be either common information which is found on all of the cards, e.g., the name of the state issuing the driver's license, or information which is specific to the individual document (such as a serial number) or the individual person or object identified in the card. This latter type of individual specific information may or may not be information which is unique to the individual.

The distinction between individual specific and unique information is illustrated by the differences between the information found on the illustrated card 10. The organ donor status of the identified individual is individual specific information because it designates the organ donor status of the identified individual. However, in a card system with more than a nominal number of identified individuals, there will be a large number of people with the same organ donor status, e.g., "Y" for individuals who have agreed to donate organs. Thus, the organ donor status information will not be unique to the individual. Similarly, the date of birth of each individual will be individual specific information but is unlikely to be information which is unique to the identified individual. No two individuals holding a card 10, however, will have the same driver's license number. Thus, the driver's license number is information which is unique to the individual person or card.

The illustrative embodiment of card 10 includes a ghost image 30 of the photograph 14 on the card over which information may be printed. The ghost image is a duplicate of photograph 14 but is printed at a much lighter tone so that darker text printed over the ghost image can be easily read. The use of such a ghost image makes it difficult for a person who has obtained the card of another individual to substitute their own photograph 14 in the card. A comparison of the photograph 14 and ghost image 30 will immediately reveal any such substitution.

Printing text over a ghost image also makes changing the text by scratching out the original text and replacing it with different text more difficult. This is because such a "scratch and replace" approach will be likely to scratch the ghost image in a manner which can be visually detected.

The name and address 12, date of birth 18, photograph 14, as well as much of the other information contained on the card is printed on a scale which is sufficiently large to allow a person viewing the card to read this printed matter without magnification. The printed matter on card 10, however, also includes micro-printed matter which is printed at a second, significantly smaller scale. On illustrated card 10, this small scale printed matter includes the last two digits of the year in which the identified individual was born 24 (as in FIG. 1D), and 25 (as in FIG. 1A), the individual's full date of birth 26, and the state name 28. The small scale text 24, 25, 26, 28 (see, FIGS. 1A, 1B, 1C, 1D is printed at a scale, e.g., a 2 point font, which can be read by many people with the unaided eye but which requires magnification for the text to be easily resolved with sufficient clarity to be read. Alternatively, the text could be printed at an even smaller scale such as a 1 point font which, for a significant number of people, would require magnification for the text to be resolved by the viewing person with sufficient clarity to be read.

As can be seen in FIG. 1, the last two digits of the year of birth of the identified individual 25 are micro-printed on card 10 to take the place of periods behind the initials of the Commissioner issuing the identification card 10. The year of birth of the individual is also printed at a large scale elsewhere on the card as indicated by reference numeral 18. A second micro-printed text 26 of the individual's year of birth is located elsewhere on the document overlaying a graphical element and is also spaced from the large scale text displaying that same information.

Longer strings of micro-printed text may also be employed. For example, micro-printed text 28 of the individuals full date of birth is shown located within the state emblem 27. In addition to the micro-printed individual specific information, i.e., the individual's year and date of birth 24, 25 and 26, information which is common to all of the cards is also micro-printed on card 10. The micro-printed common information 28 is the name of the issuing state in the illustrative embodiment.

The micro-printing of information common to all of the cards helps deter counterfeiting of the cards by making duplication of the cards difficult. This common micro-printed text, however, does not prevent someone from altering individual specific information on a validly issued card. Micro-printing the individual specific information which is most likely to be altered helps deter and detect such alterations by allowing the large scale text to be compared to the more difficult to alter small scale text. One item of individual specific information for which there is often significant concern of alteration is the date of birth of the identified individual. Driver's licenses are often used to check the age of individuals who purchase alcohol and underage individuals have been known to alter the year of birth on their driver's license to enable them to illegally purchase alcohol.

Printing equipment which is capable of producing text at very small scales is becoming widely available and can be used to economically produce identification cards with small scale text which varies from card to card. The use of such printing equipment facilitates the production of card 10. Such equipment may also be used in an attempt to alter a pre-existing card 10. To alter a pre-existing card 10, however, the small scale text could not merely be printed on a fresh document. Instead, to alter a document, the original small scale text would have to be removed and then new small scale text would have to be reproduced on the existing card at the precise location and orientation of the removed original small scale text. Such alterations present considerable pragmatic obstacles to those contemplating the alteration of information which is reproduced elsewhere on the card at a small scale. Thus, micro-printing individual specific information on an identification card when creating the card is relatively inexpensive yet at the same time creates meaningful obstacles to the alteration of that information.

This use of micro-printed text can be disclosed to the public at large or kept confidential. There are advantages to each approach. Publicizing the use of such text can have a deterrent effect. Maintaining the use of such text confidential can make detection of alterations and counterfeit documents easier if the malfeasors do not attempt to alter or counterfeit the micro-printed text. Alternatively, by utilizing micro-printed text at two locations and publicizing only one, the entity issuing the cards can attempt to realize the advantages of both of these approaches.

The information which is printed at the second smaller scale may also be encrypted so that the smaller scale information represents the same information as the larger scale information but is not a visually identical reproduction of the larger scale information. For textual matter, the smaller scale information may also be printed using a different font than the larger scale information. Where different fonts are used and the information is not encrypted, the small scale text is also not a visually identical reproduction of the larger scale information. However, in the applications where the small scale information is encrypted or reproduced in a different font, the small scale information still represents the same underlying informational content as the large scale information but does so in a manner which is not a graphical reproduction of the large scale information.

Although only a single exemplary embodiment of an identification card has been illustrated in the drawings, those having ordinary skill in the art will recognize that the disclosed invention is not limited to the illustrated embodiment. For example, a driver's license number, social security number or cardholder name could be reproduced on a small scale instead of, or in addition to, a date of birth. The present invention may also be used with employee tags and the individual's employee number, clearance rating or other individual specific information can be reproduced at a small scale.

Figure 2:
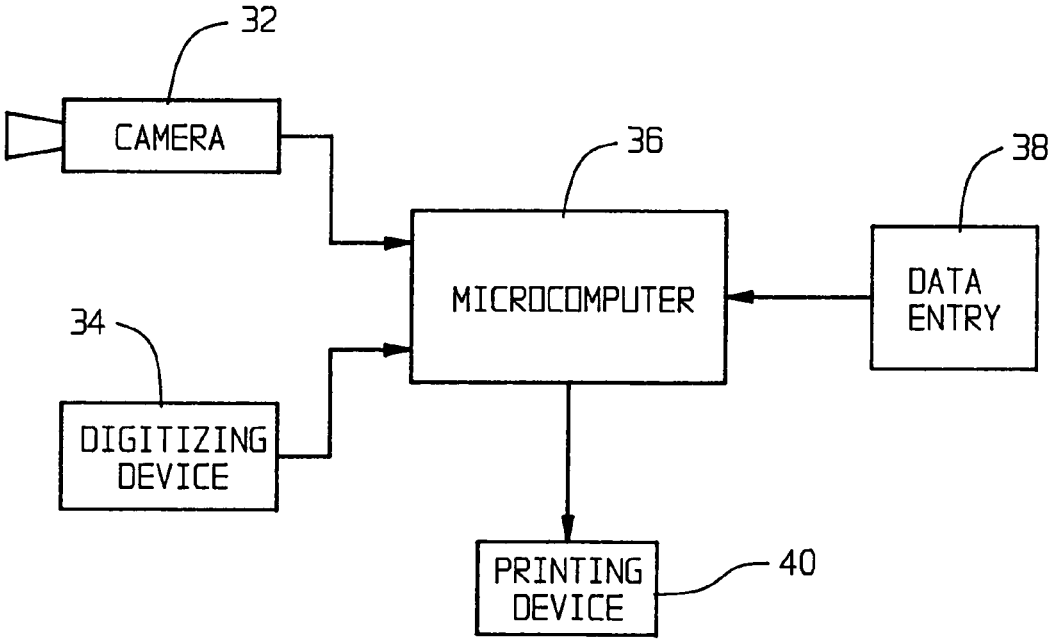
FIG. 2 is a block diagram of an apparatus for producing identification cards embodying the present invention.

Turning now to FIG. 2, one possible arrangement of an apparatus for creating cards with card specific micro-printed text is illustrated in highly schematic form. The illustrated apparatus includes a digital camera 32 for capturing a digital image of the person identified in card 10, a digitizing device 34 for converting analog information into digital information, a micro-computer 36, a data entry device 38 and a printing device 40. The illustrated apparatus may take various forms and utilize different components depending upon the type of information which is to be printed on the identifying document. For example, a camera would not be necessary if the document will not include a photographic image.

Digital camera 32 is a conventional digital camera of which there are many suitable cameras widely available and well known in the art. Device 34 may be a scanner for digitizing an image of the identified person's signature, fingerprint, an analog photograph and/or other identifying information. Alternatively, device 34 can be a capture device for directly digitizing a person's signature, fingerprint and/or other identifying information. Data entry device 38 may be a keyboard for entering individual specific information such as the name, address, birth date etc. of the identified individual.

Micro-computer 36 is a conventional personal computer having a micro-processor such as a commonly available and well known Pentium® chip manufactured by Intel. Micro-computer 36 receives, stores and manipulates the digital images and data and subsequently produces an output which is transferred to printing device 40. Those persons having ordinary skill in the art will recognize that instead of using a separate personal computer, a wide variety of alternative configurations which might employ a network server or micro-processors integrated with one or more of the other pieces of the illustrated apparatus could be used to achieve the same functionality as the illustrative embodiment.

Computer 36 also includes storage media on which computer programs are stored for receiving digital information from devices 32, 34 and 38, processing the information and outputting digital information which can be processed by printing device 40 to generate identification document 10. The computer programs stored within computer 36 may include an identification card template to which card specific information is added prior to generating an identification document 10.

Prior to entering card specific information in the card template, the card layout or template must be designed. An extremely large variety of different document layouts can be used with the present invention. One illustrative process for designing an identification document is to begin with the step of designing and digitizing a graphical background for the document. This may be done with a conventional desktop publishing software program.

Figure 3:
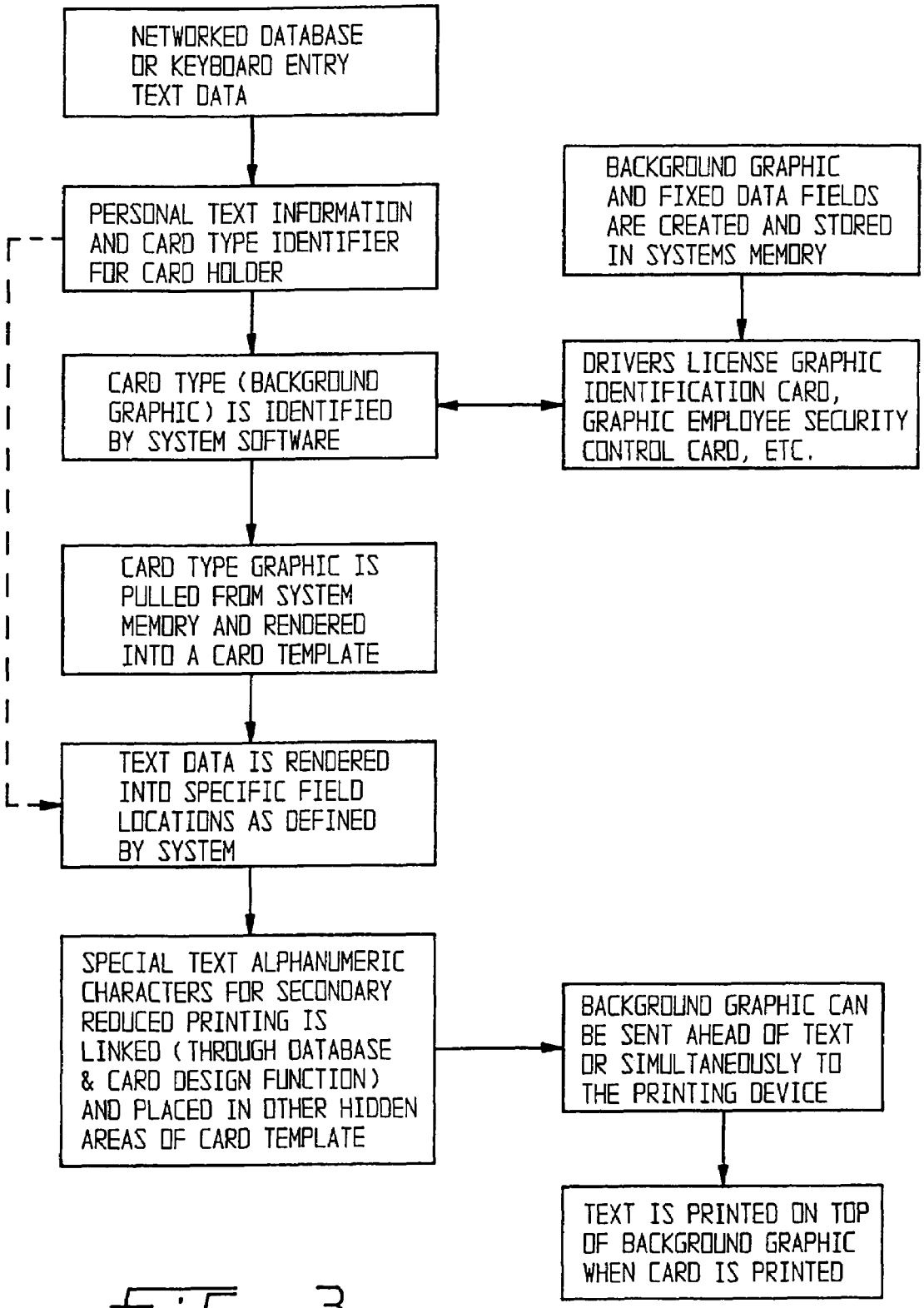
FIG. 3 is a flow chart of a software package and process which may be used to implement the present invention.

FIG. 3 provides a flow chart which illustrates a process which may be used in the implementation of the present invention. Some of the specific software programs which may be utilized when carrying out the invention include EPISUITE by G & A Imaging, Ltd. of Hull, Quebec; Identifier for Windows by Imaging Technology Corp. of Hudson, Mass.; and IDS 7100 by NBS Imaging Systems Inc. of Fort Wayne, Ind.

The background graphic may advantageously include several medium tones such as gray or light blue which can be used for "hiding" the small scale text. The background graphic is then imported into a software program along with variable text fields which are placed in specific areas on top of the background graphic to create a card layout or card template. In addition to the conventional large scale text fields comprising such items of information as the cardholder name and date of birth, these text fields should include smaller scale relatively dark toned textual matter at a font size of 2 or 3 points or less located on top of the medium-toned portion of the earlier designed graphical background. The dark text on medium-toned (or light-toned) background permits the text to be read while minimizing the contrast between the dark text and background. Similarly, light-toned text can be placed on a darker-toned background. Minimizing the contrast between the small scale text and background reduces the possibility that persons viewing the card will notice the small scale text and thereby "hides" the text in the background color. In card 10, the "hiding" of text is exemplified by small scale text 24 which consists of two dark toned numerals printed over a medium-toned background color 23.

Another method of making the small scale text visually unobtrusive is to place the small scale text within a complex graphical image. In this manner the discontinuities in tone and hue created by the small scale text will be surrounded, and camouflaged, by other small scale discontinuities in tone and hue created by the surrounding and underlying image. In card 10, this is exemplified by placing small scale text 26 in a state emblem 27.

The small scale text can also be printed on a portion of the card which does not include a background color as illustrated by the two periods 25 in card 10. By placing the small scale text on a clear or white background, the text will be more apparent and easier to read when verifying the accuracy of the large scale text.

When producing cards for individual cardholders, individual specific information is input into the appropriate text fields in the card template and the resulting identification card is output to the printing device and a hard copy of the card is generated by the printing device.

Printers capable of printing small scale text are well known in the art. For example, NISCA, Hitachi, DataCard and Atlantek all manufacture 300 dpi (i.e., dots per inch) dye diffusion thermal transfer printers which can be used to print small scale text in a manner known in the art. Indigo, a Netherlands company, manufactures a Digital Offset printer under the trademark E-Print 1000 which is known in the art and may be used to implement the present invention.

As will be recognized by those having ordinary skill in the art, high quality ran color laser copiers may be used instead of printers to generate the identification documents. For example, Canon and Xerox both make color laser copiers capable of implementing the present invention in a manner well known in the art. As with conventional printers, such copiers have a digital interface which allows them to receive digital data and print a hard copy image therefrom.

With a printing device which produces images at a resolution of 300 dpi (and even up to 200 dpi), the small scale text can be reduced to a 2 point font and still be clearly and legibly printed. With higher resolution printing devices, such as printers with a resolution of 800 dpi, the size of the text can be reduced to an even smaller scale while still clearly and legibly printing the text.

It is also envisioned that cards 10 can have more complex images reduced to a small scale. For example, a signature or photograph of the identified individual could be digitally reduced in scale and reproduced on card 10. More complex images, however, require more sophisticated software to appropriately reduce the image and higher resolution printing devices to clearly and legibly reproduce the complex image—both of which would add to cost of producing documents having such reduced scale complex images.

Often times color printing devices utilize ribbons having panels of only a limited number of colors and several passes must be made to overlay different colors on a particular location to produce certain colors by the resulting combination. By including a panel of the color used to print the small scale text (such as black) only one printing pass is required for printing the small scale text and the potential for problems associated with maintaining the proper registration of the card stock beneath the printer to properly overlay the different colors to form the final color of the small scale text is minimized.

Card stock on which card 10 is printed may be a polyvinyl chloride (PVC), a polyester, a polycarbonate, a polyolefin (such as the polyolefin-based film manufactured under the mark Teslin by PPG of Pittsburgh, Pa.), or other suitable material. It is possible to preprint some of the printed matter which is common to all of the cards on the card stock prior to printing individual specific material on the card stock. It is generally preferable, however, to print the entirety of the card at one time.

The apparatus for printing the cards may be located at a single location, or some portions of the apparatus may be located at a central site. When different locations must be interconnected, information may be conveyed between the different apparatus components via a network, telecommunication line or other well known data transfer means.

While the present invention has been disclosed and illustrated with reference to an identification card, it could also be modified and implemented with other valuable documents. For example, it could be used with checks and other negotiable instruments or even paper money, by using unique serial numbers with the documents and micro-printing the serial number of the instrument on the document (and/or the monetary amount of a money order or certified check). It is envisioned that the large scale implementation of such a system with such valuable documents could enable the use of automated verification means which would employ OCR (optical character recognition) technology to read and compare the large scale and small scale printed matter.

Thus, while this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A self-authenticating identification document comprising:

first printed matter rendered at a first location on said document and at a first scale enabling said first printed matter to be resolved by a viewing person without magnification, said first printed matter conveying identifying information;

second printed matter comprising information that communicates the same identifying information as said first printed matter, the second printed matter rendered at a second microscale and at a second confidential location on said document and in a second color, said second microscale being significantly smaller than said first scale, said second confidential location being spaced from said first location and being selected and arranged to be a location that is not generally known, and said second color being selected to effect minimal contrast between said second printed matter in said second location and its immediate background;

wherein the combination of said minimal contrast, said second confidential location, and said second microscale is constructed and arranged to substantially hide the existence and location of said second printed matter from the naked eye and prevent said second printed matter from being substantially detected or resolved unless a viewing party knows the second confidential location and views said second printed matter using a magnification lens; and wherein a comparison of the second printed matter to the first printed matter is capable of determining the authenticity of the identification document.

2. The identification document of claim 1 wherein said second printed matter consists of text rendered in a single color, said color being selected to effect minimal contrast between said second printed matter in said second confidential location and its immediate background.

3. The identification document of claim 1 wherein said second printed matter consists of relatively dark toned text printed on a background color which is lighter toned than said text, said light tone and said darker tone constituting a tone difference, said tone difference being selected to effect minimal contrast between said second printed matter in said second confidential location and its immediate background.

4. The identification document of claim 1 wherein said second printed matter consists of relatively light toned text printed on a background color which is darker toned than said text, said light tone and said darker tone constituting a tone difference, said tone difference being selected to effect minimal contrast between said second printed matter in said second confidential location and its immediate background.

5. The identification document of claim 1 wherein said identification document identifies a particular person and said identifying information comprises at least one of information specific to the identified person and information specific to the identification card.

6. The identification document of claim 1 wherein said first and second printed matter comprise alphanumeric characters.

7. The identification document of claim 1 wherein said first and second printed matter comprises at least two digits of the year of birth of a person identified in the document.

8. The identification document of claim 1 wherein said second printed matter is a graphical reproduction of said first printed matter.

9. The identification document of claim 1 wherein said second printed matter is printed within a graphical image having sufficient complexity to camouflage said second printed matter from the naked eye.

10. The identification document of claim 1 wherein said first printed matter communicates said second printed matter in an encrypted form.

11. The identification document of claim 1 wherein said first and second printed matter comprise identifying information that is determined most likely to be altered.

12. A method of printing a self-authenticating document containing identifying information for a particular person comprising:

providing a base card;

printing first information which is specific to the particular person identified on said base card at a first location and at a first scale enabling said printed information to be perceived without magnification; and printing second information at a second micro scale and at a predetermined secret second location on said document, and in a second color, said second information comprising information capable of communicating the same identifying information as said first information, said second micro scale being significantly smaller than said first scale, said second location being spaced from said first location, and said second color being selected to effect minimal contrast between said second information in said second location and its immediate background, the combination of said predetermined secret second location, minimal contrast and said second microscale substantially hiding said second information from the naked eye and preventing said second information from being clearly perceived unless said the second information is viewed using a magnifying lens by a party with knowledge of the predetermined secret second location;

wherein a comparison of the second printed matter to the first printed matter is capable of determining the authenticity of the identification document.

13. The method of claim 12 wherein said step of printing said second information at said predetermined secret second location consists of printing said second information in a single color, said color being selected to effect minimal contrast between said second information in said second location and its immediate background.

14. The method of claim 12 wherein said step of printing said second information at said second predetermined secret location consists of printing said second information in a relatively dark toned color on a lighter toned background, said light tone and said darker tone constituting a tone difference, said tone difference being selected to effect minimal contrast between said second information in said second predetermined secret location and its immediate background.

15. The method of claim 12 wherein said step of printing said second information at said second predetermined secret location consists of printing said second information in a relatively light toned color on a darker toned background, said light tone and said darker tone constituting a tone difference, said tone difference being selected to effect minimal contrast between said second information in said second predetermined secret location and its immediate background.

16. The method of claim 12 wherein said step of printing said second information at said second predetermined secret location comprises graphically reproducing said first information.

* * * * *